US010220917B2

(12) United States Patent
Pisapia

(10) Patent No.: US 10,220,917 B2
(45) Date of Patent: Mar. 5, 2019

(54) UNIVERSAL AND RAPID COVERING SYSTEM

(71) Applicant: Antonio Pisapia, Naples (IT)

(72) Inventor: Antonio Pisapia, Naples (IT)

( * ) Notice: Subject to any disclaimer, the term of this patent is extended or adjusted under 35 U.S.C. 154(b) by 0 days.

(21) Appl. No.: 15/543,368

(22) PCT Filed: Jan. 12, 2016

(86) PCT No.: PCT/IT2016/000006

§ 371 (c)(1),
(2) Date: Jul. 13, 2017

(87) PCT Pub. No.: WO2016/113767

PCT Pub. Date: Jul. 21, 2016

(65) Prior Publication Data

US 2018/0001965 A1 Jan. 4, 2018

(30) Foreign Application Priority Data

Jan. 15, 2015 (IT) ..... NA2015A0001

(51) Int. Cl.

| | |
|---|---|
| ***B63B 17/02*** | (2006.01) |
| ***E04H 15/04*** | (2006.01) |
| ***E04H 15/06*** | (2006.01) |
| *B63C 15/00* | (2006.01) |
| *E04H 6/04* | (2006.01) |

(52) U.S. Cl.

CPC ..... *B63B 17/02* (2013.01); *B63B 17/023* (2013.01); *E04H 15/04* (2013.01); *E04H 15/06* (2013.01); *B63C 15/00* (2013.01); *E04H 6/04* (2013.01)

(58) Field of Classification Search

CPC ..... E04H 15/001; E04H 15/02; E04H 15/04; E04H 15/06; E04F 10/04; B63B 17/02; A01G 13/043; A01G 2013/046

USPC ..... 47/22.1, 29.6, 29.7, 31; 4/498, 500

See application file for complete search history.

(56) References Cited

U.S. PATENT DOCUMENTS 544,871 A * 8/1895 Turner ..... E04H 15/04 118/DIG. 7
645,890 A * 3/1900 Conrad ..... A01G 13/043 135/90
969,899 A * 9/1910 Partington ..... E04H 15/04 135/90

(Continued)

FOREIGN PATENT DOCUMENTS

CA 2166039 A1 * 6/1997 ..... E04H 1/1205

*Primary Examiner* — David R Dunn
*Assistant Examiner* — Danielle Jackson

(57) ABSTRACT

A universal and rapid system suitable for covering boats or any other vehicle and object. The purpose is to realize a covering system which is practical, functional in the positioning phase and compact in storage, to overcome problems related to water stagnation and bad air circulation, and to get the advantage of waterproofing, of protection from atmospheric agents. The system comprises a cover (1), a coupling means (10) placed on it, a system for lifting (38) anchored to a support structure (39) wherein said cover (1) is connected to a sleeve (15). The system, in its several applications, diversifies itself for the various possible embodiments of the several elements constituting the system, for example for the type and shape of the cover, for the type of the sleeve, for the modalities of anchoring.

13 Claims, 10 Drawing Sheets

(56) References Cited

U.S. PATENT DOCUMENTS

| | | | | | |
|---|---|---|---|---|---|
| 1,285,766 | A * | 11/1918 | Martin | E04H 15/04 | 135/120.2 |
| 1,759,628 | A * | 5/1930 | Pellegrino | B60J 11/00 | 135/90 |
| 4,764,998 | A * | 8/1988 | Norris | A63C 19/12 | 242/390.8 |
| 4,817,654 | A * | 4/1989 | Christensen | B60J 11/00 | 135/90 |
| 5,086,988 | A * | 2/1992 | LaPoint | B65H 75/406 | 242/395 |
| 5,261,435 | A * | 11/1993 | Stanley | E04H 6/04 | 135/90 |
| 5,269,332 | A * | 12/1993 | Osborne | E04H 15/04 | 114/361 |
| 5,621,926 | A * | 4/1997 | La Madeleine | E04H 4/10 | 135/120.4 |
| 6,338,356 | B1 * | 1/2002 | Wallenstatter | E04H 15/04 | 135/100 |
| 7,849,866 | B1 * | 12/2010 | Mangum | A47K 11/04 | 135/117 |
| 7,987,807 | B2 * | 8/2011 | Mikacich | B63B 17/02 | 114/361 |
| 8,381,749 | B1 * | 2/2013 | Ashmore, Jr. | E04H 15/001 | 135/90 |
| 9,127,476 | B2 * | 9/2015 | Cornew | E04H 15/28 | |
| 2015/0030790 | A1 * | 1/2015 | Duncan, III | E04H 15/04 | 428/34.1 |
| 2017/0215408 | A1 * | 8/2017 | Swanson | A01M 31/025 | |

* cited by examiner

UNIVERSAL AND RAPID COVERING SYSTEM

TECHNICAL FIELD

The present invention provides a universal and rapid system for covering suitable for boats and for any other vehicle and object, provided with a sleeve which gives the system the advantage of being able to quickly deploy or stow the cover, depending on the needs.

DESCRIPTION OF THE PRIOR ART

Nowadays the fabric covers used are not easily adaptable to the irregular shape of the boats. More than one cover are often used in an attempt to better adapt them to the shape; this, however, involves a great waste of energy in order to reach the correct positioning; more generally, the use of more portions of fabric from the irregular shape and their difficult connection, frequently generates episodes of water infiltration in between the joints and above all require a long employment of energy and time.

There are also covering systems, sometimes custom made, that cover vehicles, including nautical means, in their entirety, but often, the lack of them lies in the frequent occurrence of stagnant water, as well as in the harsh effort that is required for the correct positioning, and subsequent storing of the cover. Sometimes, a rod is placed below the cover or externally to it, in order to stretch it and avoid the water stagnation, leaving the problem of storage unresolved. In addition some of these systems, in order to attach the cover to the object covered and to tighten it better, provide anchoring means on their perimeter, which, however, are not practical in application, are potentially harmful to the object to be covered and dangerous for people.

In particular, for the nautical means, such as boats, there is a further disadvantage due to the fact that as the fabric is not well positioned it tears in correspondence with anchorage points causing it to constant fluttering which, in addition to continue ruining the fabric it no longer protects the thing covered.

Other types of cover are made of polyethylene or are thermo retractable. These, are not appropriate when there is a frequent use of the object, due to the length of time needing for the system positioning and sometimes the access to the object/vehicle covered is prevented, until the cover removal. In addition, their use is often limited to a single season since, once removed, they are difficult to reuse.

Other types of system have a rigid sleeve for cover storage, they allow the cover to pull itself into the rigid custody, via ropes or similar. This, as cover extension increases, can result physically heavy and difficult as the cover could frequently get caught in the object covered during the storage operations, causing them to interrupt and a consequent loss of time or the need of at least two people to facilitate the various stages of use. Furthermore, the rigid sleeve characterizing these systems has limitations: it results not universal, which means that is not always applicable in the lack of an appropriate support base, this is related to the weight and to the occupied volume of the sleeve, which increase proportionally with the size of the cover; the rigid sleeve is penalized by an absent, or limited, motility making the utilization stages of the system more difficult; its installation required the intervention of two people with appropriate facilities and technical knowledge, anyway resulting physically heavy and time-consuming; furthermore, it being also a fundamental structural element represents a limitation in several ways: for example if there is the need to transport the cover anywhere else while is protected inside the sleeve or, while not in use, to carry out maintenance, the temporary removal of the rigid sleeve, wherever possible, couldn't be done in a practical and quick way, moreover if the rigid sleeve is removed while the cover is in use, the system would not guarantee that the performance characteristics of covering, such as the fabric tension, remain the same as before the removal.

What is often common to all these methods is bad air circulation, which increases the probability of condensation appearance and fungal growth.

Without any doubt in all the existing covers, the difficulties of positioning and storage, as well as accessing inside the vehicle after the covering, increase proportionally to the cover size.

All of this, frequently, can lead to the waivering of whole vehicle coverage, specifically boat, because of the difficulties and the commitment it requires.

To avoid these inconveniences and to obtain further advantages, the Applicant studied and used/utilized the present invention.

DISCLOSURE OF INVENTION

The present invention is disclosed and characterized in the independent claim. Others characteristics of the present invention are exposed in the dependent claims.

The purpose of the present invention is to provide a covering system for means of transport and whatever needs covering operation, which has several features: it is universal, namely that is always usable, also thanks to its low weight such as not requiring a cumbersome and unwieldy support structure; it is practical, functional in the positioning phase and compact in storage; its assembly, disassembly and usage can be practically and easily made by a single person without technical knowledge. Others purposes of the invention is to overcome the problems related to water stagnation and bad air circulation, to obtain full advantage of waterproofing, of protection from atmospheric agents and of reduction of the ordinary and extraordinary external maintenance of the thing covered.

In an embodiment of the invention, the system comprises a cover composed of a water-repellent fabric on the upper part and a breathable, windproof and elastic fabric on the lower part.

The breathable and windproof characteristics of the lower part significantly slow the wind impact and all its negative effects down, even if the cover is of a considerable size, and the elasticity makes it easily possible to adhere the cover to the thing covered, even in presence of surface irregularities. The junction of the fabrics is made using a rope passing through several eyelets, interspersed with slots which allow a connection between the exterior and the inner part of the cover in order to allow easy access to the covered object, for example to place boat fenders for nautical means, or anchoring or whatever necessary to the cover accessories, avoiding operational discomfort that other type of coverage presents.

The windproof, breathable fabric, because of its elasticity, makes possible to tighten and regulate the fastening and to mold the cover over the object using a parametrical element, which in an embodiment of the invention can be a rope placed at its edge and in the relative loops. In good weather conditions, it is however possible to secure only the water-repellent fabric using a quick method, which in an embodiment of the invention could be spring clamps, thus leaving free the edge of the windproof breathable fabric.

Externally the cover provides a coupling means, in order to allow a rapid operation of positioning and subsequent storage. This coupling means of the cover, placed on the most suitable point on the fabric, allows to tighten the entire cover through a lifting system. The lifting device is placed on a support structure which, according to the needs, can be a rod or a wall or whatever allows to adjust the positioning and tightening of the cover inclining it in the right way. This suspension from above significantly facilitates the managing of also considerable size covers, handled by a single person.

In an embodiment of the invention, the coupling means of the cover can be a joint in the shape of a disc with a hook positioned on its center.

In an embodiment of the invention, the support structure comprises of a rod placed on the radar arch of a boat via a dedicated casing, or on the quay.

The position of the coupling means of the cover may be selected on the most suitable point of the cover, in consideration of the shape of the element to be covered, in the position that makes its operating in the various phases more comfortable.

The system, according to the invention, comprises of a sleeve made of fabric or of a series of rings connected to each other and spaced with ropes or made of any other suitable material, said sleeve, by sliding from the upper part of its anchoring means downward, encases the cover and practically and quickly reduces its dimensions, allowing easy storage. The presence of this sleeve which is not rigid, but mobile, removable and with a specific collocation within the system, allows to solve several problems existing in the systems known to the state of art up to present day and to create new advantages. Indeed, the sleeve, when not in use, fills the smallest possible space, varying its occupied volume; it makes storage stages easier, thus reducing maneuvers, energies and time required, thanks to the fact that it always ensures a correct positioning above the cover; and also, the said sleeve provides the advantage of being able to remove it from the rest of the system in a practical and quick way both with the cover inside of it, to put it in a cabinet or to transport it elsewhere, and when the sleeve is not in use, for example to carry out maintenance, in particular this is possible being able to continue to guarantee that the same performance characteristics of covering, such as the fabric tension, remain the same as before the removal; it allows the system to always guarantee the same performance characteristics of covering, such as the fabric tension, even if the sleeve is temporary removed.

In an embodiment of the invention, the cover is provided with a back opening to allow the access to the covered object any time and without any difficulties.

BRIEF DESCRIPTION OF DRAWINGS

This and other features of the present invention will be clarified in the following description of a preferential form of embodiment, given as example, non-restrictive, with reference to the following figures, in which.

DETAILED DESCRIPTION OF THE EMBODIMENTS OF THE INVENTION

The invention allows use and storage of a cover in simple and quick proceedings. Features and components of the invention in a preferential embodiment will be described according to the orientation of the boat (8) showed in FIG. 1. Thus, the directional terms such as front and rear will be referred to the orientation of the boat (8) in FIG. 1. In any case directional terms are indicative and just for the purpose of description and are not intended limiting.

Figure 1:
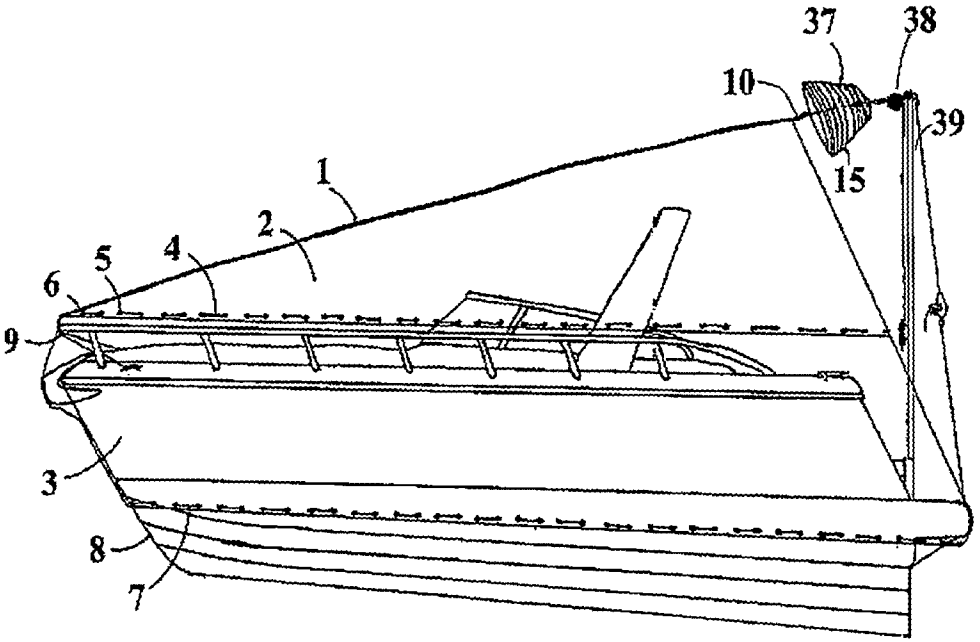
FIG. 1 is a side view of the present invention showing the covering system applied on a boat, according to an embodiment of the present invention
Figure 2:
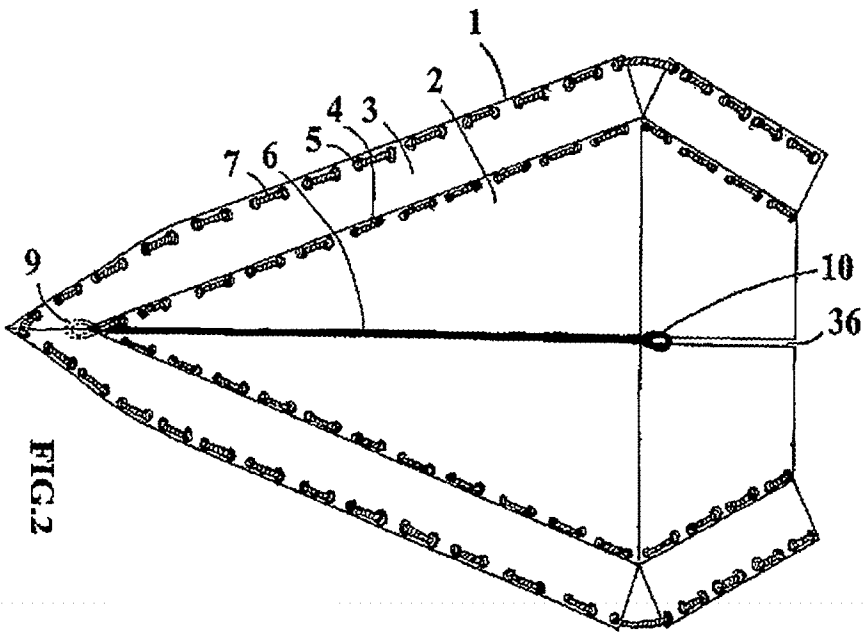
FIG. 2 is a plan view of the cover, according to a preferential embodiment of the present invention

In FIGS. 1 and 2 is illustrated a cover (1) preferably consisting of two different fabrics. The upper one (2) preferably water-resistant and the lower one (3) preferably windproof, breathable and elastic. Fabrics are preferably made of any suitable material, including cotton, nylon and polyester. Fabrics (2) and (3) are joined together by a rigid or elastic rope (4), passing through eyelets (5).

A reinforcing fabric (6), preferably a belt, is applied on the cover (1), in correspondence with the main ridge line, on the whose rear end is places a hook (9), to facilitate the anchoring of the cover (1), while on the front end is placed a hook, as coupling means (10) of the cover.

Figure 3:
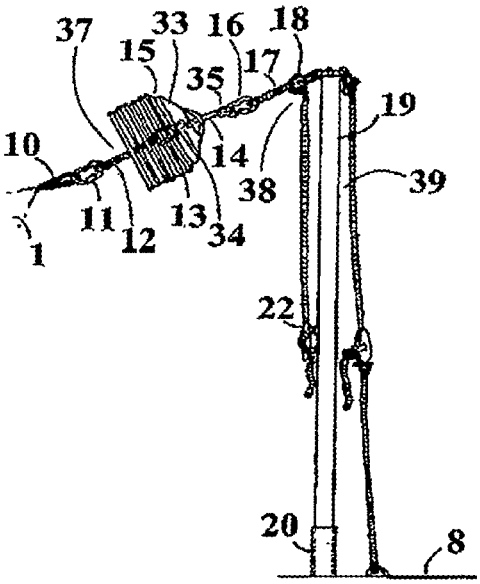
FIG. 3 shows a portion of the system illustrating the lifting system and the support structure according to a preferential embodiment of the invention

FIGS. 1 and 3 show the combination of cover (1), sleeve (15), system for lifting (38), and support structure (39). In particular the combination of the hook (10) of the cover (1) to the sleeve (15) takes place through the anchoring means (37) of the sleeve, which preferably comprises of a stretch of rope (12), two hooks (11, 13), a double eye (34, 35) eyebolt (14) and a disc (33). The system for lifting (38), in a preferential embodiment, comprises of a hook (16), a rope (17), a pulley (18) and an element suitable for anchoring and pulling (22) the rope (17). The support structure (39) of the system, in a preferential embodiment can be a rod (19), sustained by a suitable structure (20).

The hook (11) is preferably placed between the stretch of rope (12) and the rear hook (10) of the cover's belt. The stretch of rope (12) allows to obtain a proper place for the retraction of the sleeve (15), which is preferably made of fabric, while the cover (1) is in use. On the other end of the stretch of rope (12) is preferably placed another hook (13) in turn connected to the lower eye (34) of the eyebolt (14). The sleeve (15) is connected to the eyebolt (14), as described in FIG. 6. A rope (17) is connected to the upper eye (35) of the eyebolt (14), through another hook (16) suitable for lifting the structure. This rope (17), passes through a pulley (18) preferably placed on the summit of the rod (19), in order to support the entire system. The rod (19), besides, is placed on the boat (8) and sustained by a suitable structure (20), for example a fishing rod holder. One of the possible device for anchoring, lifting and pulling (22, 23 24) is placed on the rod (19), once the flaps of the cover (1) are brought outwards, the device, pulling the rope (17), allows to give the cover a shape and a height such as to prevent the water stagnation.

As showed in FIGS. 1 and 2, a rigid or elastic rope (7) is placed along the lower edge of the fabric (3), also via eyelets (5) to allow the fastening of the cover (1). Once the rope (7) is tight, it can be fastened to a cleat or to any point that allows a suitable anchor.

To store the cover (1) simply needs to let go the rope (7), remove the fastening and fold up flaps inwards. The sleeve (15) will slide downwards in order to make the cover (1) compact and allow an easy storage.

FIG. 2 shows that the cover is provided with a back opening (36) as to allow access to the object covered anytime and without any difficulties.

FIG. 3 shows the possibility of bracing the rod (19) in order to give more stability and safety to the invention.

Figure 4:
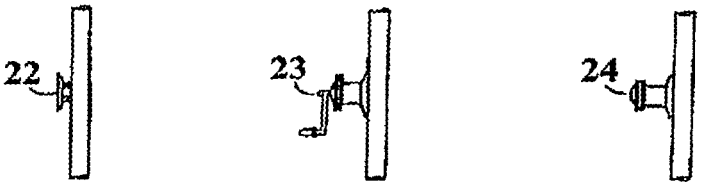
FIG. 4 is a partial view of possible components suitable for anchoring and pulling, according to a preferential embodiment of the present invention

FIG. 4 shows three possible systems for anchoring and pulling the rope (17), manual (22), mechanical (23), and electrical (24).

Figure 5:
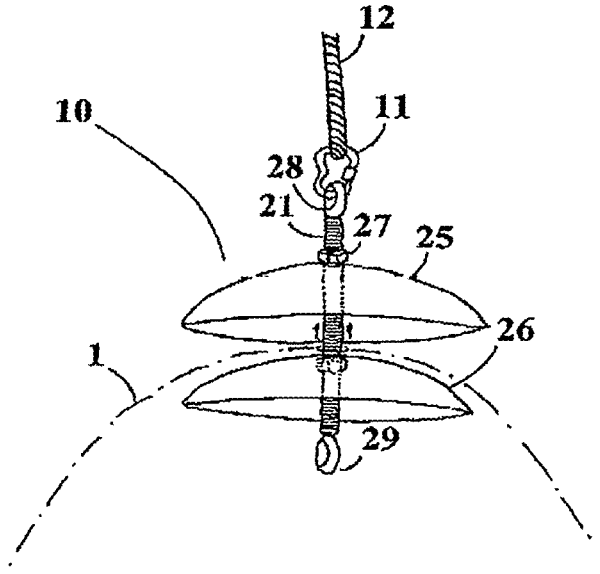
FIG. 5 shows an exploded view of a covering system's portion, according to a preferential embodiment of the present invention

FIG. 5 shows a possible application to the cover (1). With purpose of reinforcing the fabric in the selected point for the coupling means (10) of the cover, adapted to lift, two discs are preferably placed, one disc (26) below the cover and the other disc (25) above it, preferably attached via a double eye eyebolt (21) and fixed with two nuts (27). The eye (28) on the upper end, allows an easy connection to the stretch of rope (12), preferably using a hook (11). It is possible to join a maneuvering rope to the lower eye (29).

Figure 6:
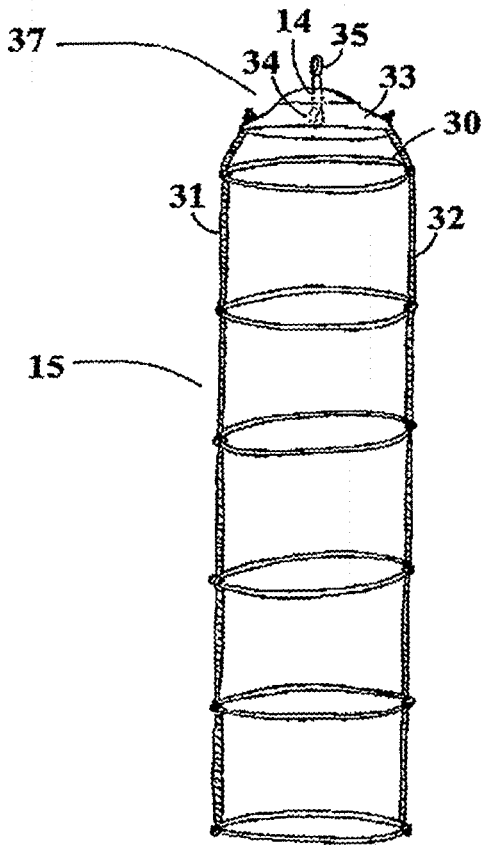
FIG. 6 shows a possible sleeve for the cover FIG. 7, 8 show various methods of application and of using of the invention on two types of vehicle

FIG. 6 shows a possible embodiment of the sleeve (15) for the cover (1), consisting of a series of rings (30) connected to each other and preferably spaced by ropes (31, 32). The rings can be made in any suitable shape and material. The anchoring means (37) is connected to upper part of the sleeve, it preferably consists of a disc (33) with a double eye eyebolt (14), to the side edges of which are fastened the ropes (31, 32). The coupling means of the cover can be directly connected to the lower eye (34) through preferably a hook (11), while the upper eye (35) will be connected to the support system.

Figure 7:
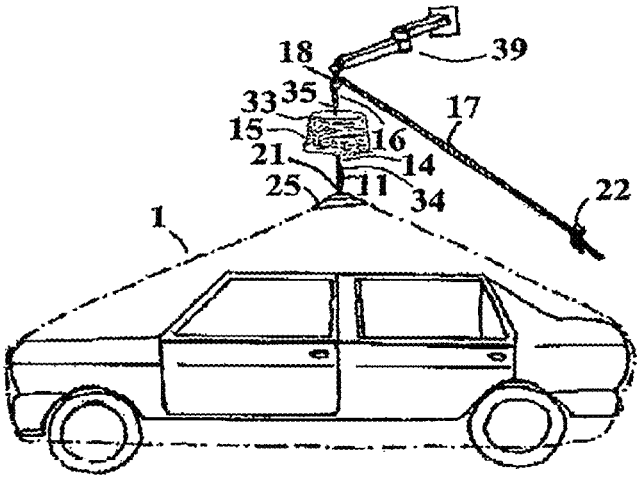
Figure 8:
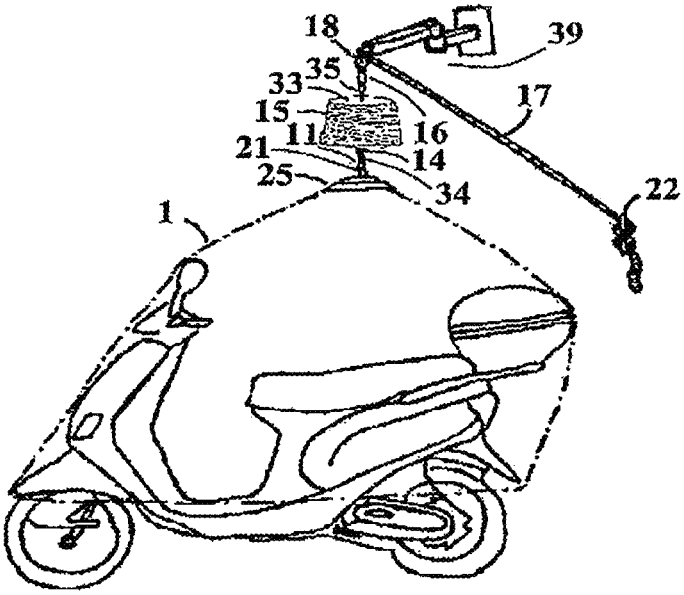
Figure 9:
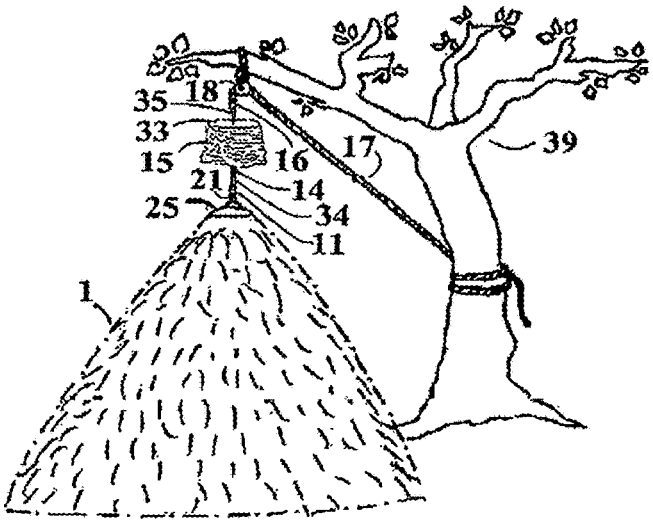
FIG. 9 shows a method of application and of using on an object

FIGS. 7, 8, 9 provided for purpose of illustration and are not intended to be exhaustive, show possible applications of the invention to vehicles and things. The cover (1), therefore, can have different shapes according to the type of vehicle or things for which it is intended.

As showed in FIG. 9, the cover could be directly fixed to any high stationary point, also a beam or a wall. This additional method of installation of the invention can be indicative, but not exhaustive.

Figure 10:
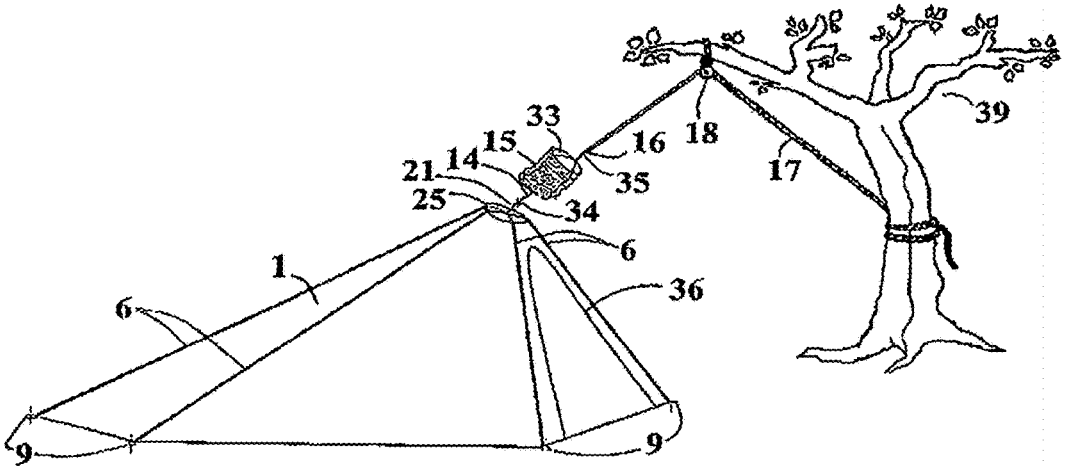
FIG. 10 shows a method of application and of using in which the cover is a camping tend FIG. 11, 12, 13, 14, 15, 16 show an example of the system application, in its using stages, according to a preferential embodiment The drawing figures are not necessarily to scale and the proportions of some parts have been increased for the sake of clarity.

FIG. 10 shows an example of application of the invention in which the cover is a camping tend.

Figure 11:
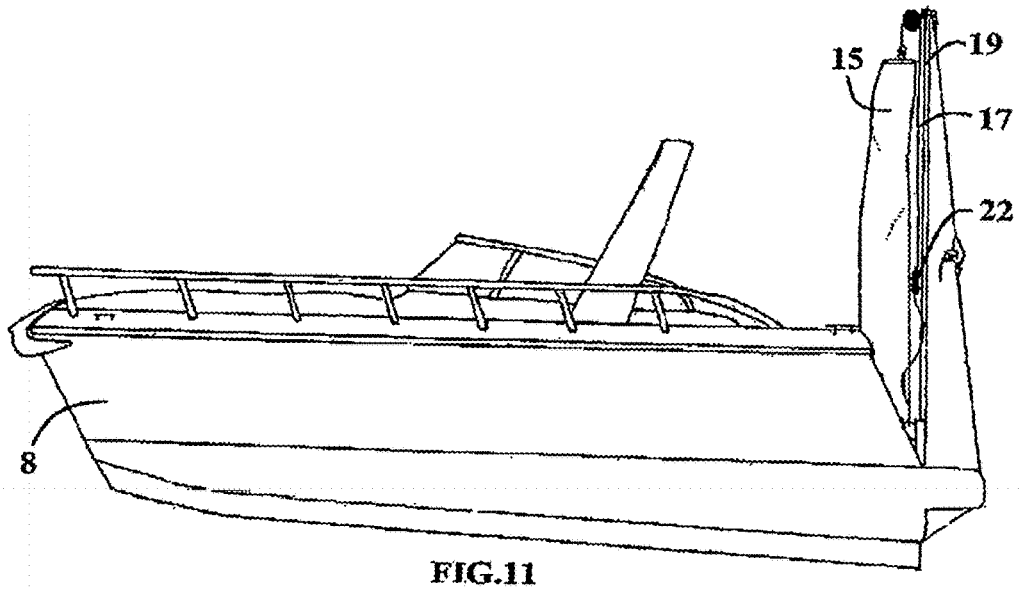
Figure 12:
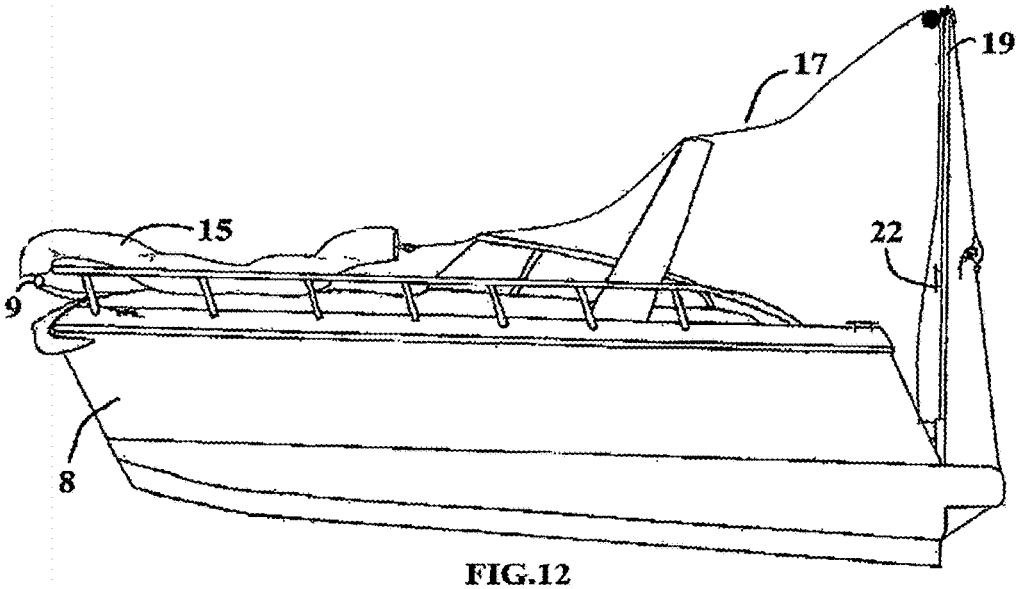
Figure 13:
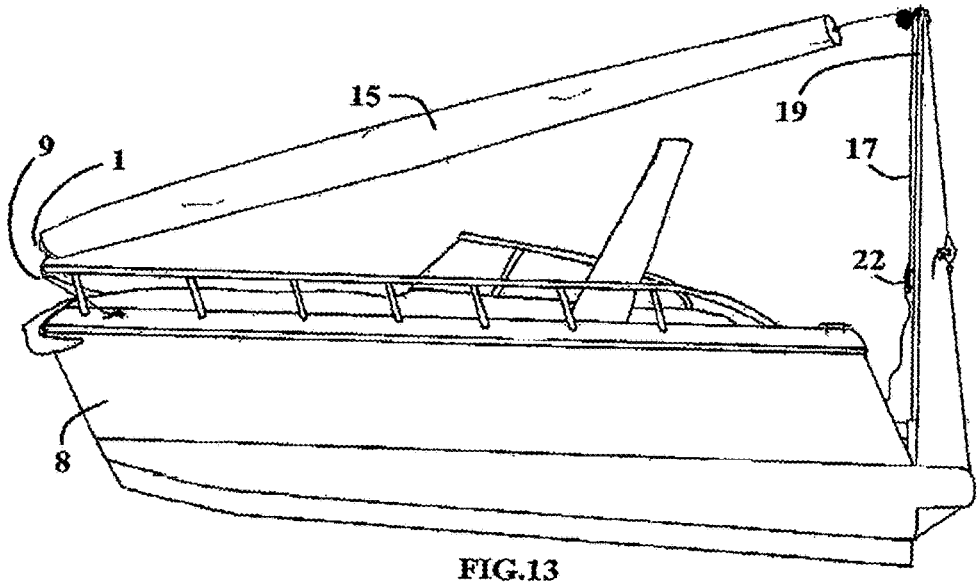
Figure 14:
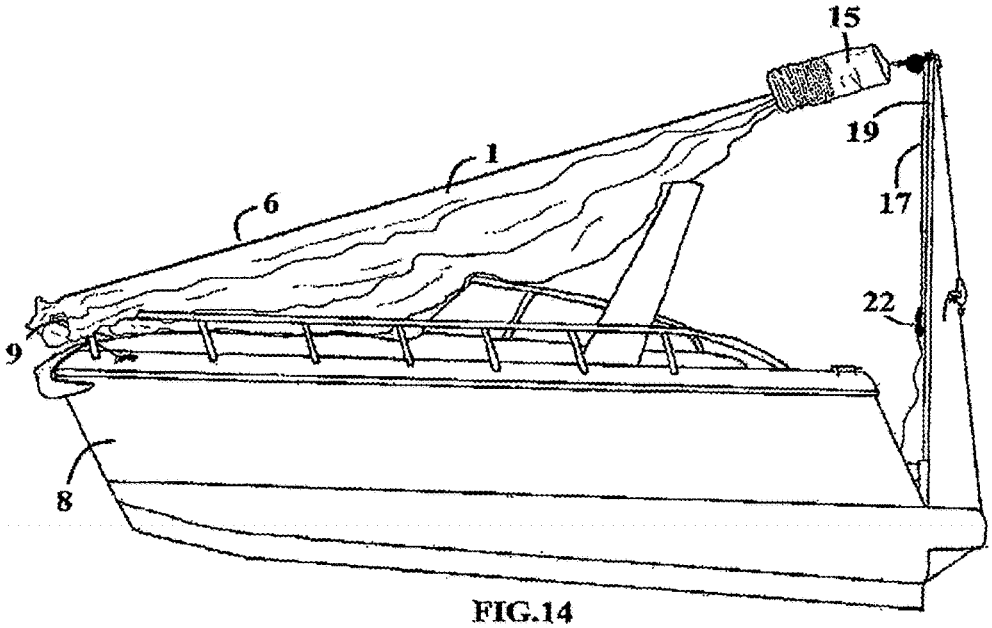
Figure 15:
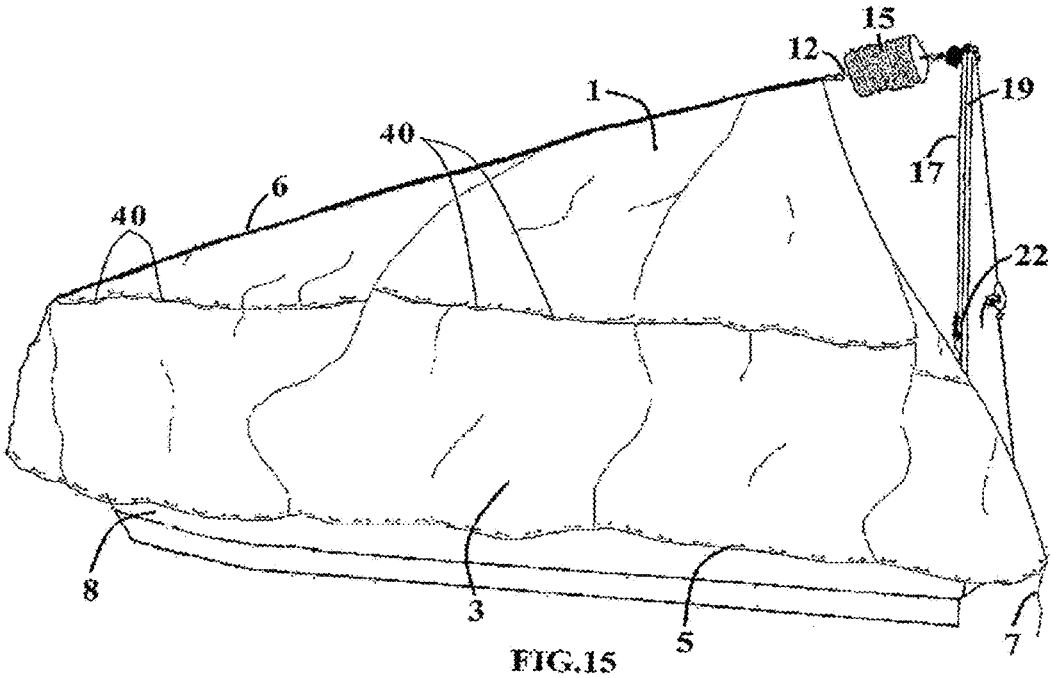
Figure 16:
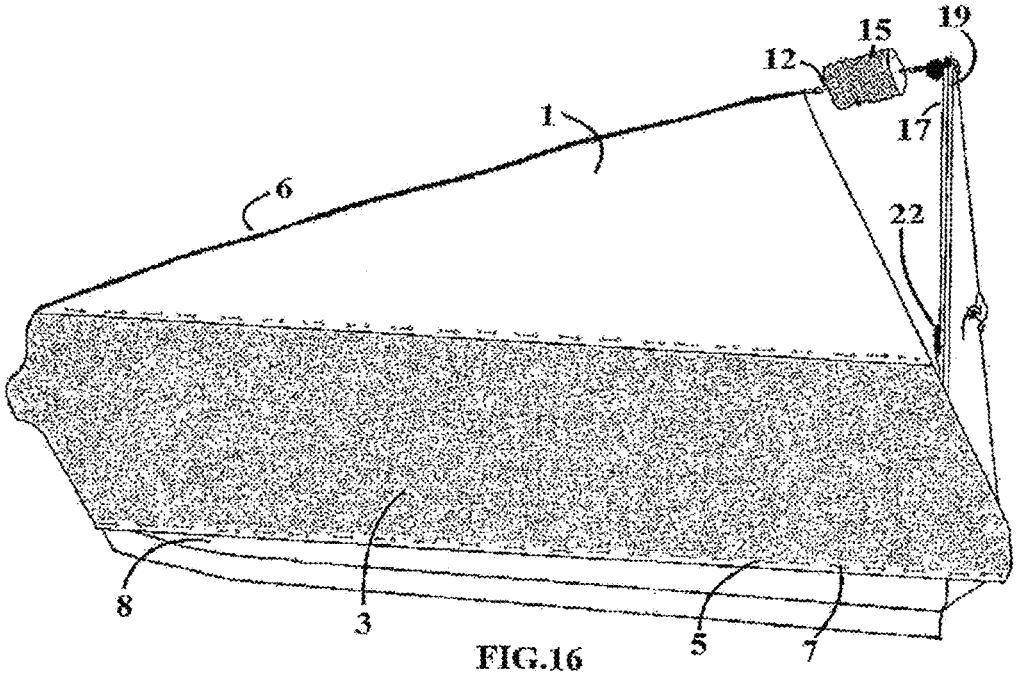

Figures from 11 to 16 show an example of application of the invention in a preferential embodiment in its various stages of use, described below: starting from the cover (1) stored in the sleeve (15), FIG. 11, the first stage is to loosen the rope (17) in order to bring the sleeve (15) towards the bow of the boat, with the lower end of it facing the bow, while the cover (1) is compacted inside. The hook (9) of the cover (1), protruding from the lower end of the sleeve (15), is placed as much as possible on the bow and, when present, externally to the handrail, and then it is fastened by ropes, or anything suitable, to the cleats of the bow or to any other suitable element, FIG. 12. Afterwards the rope (17) is pulled, until the sleeve (15), with the cover (1) inside, will not be tighten, then it is fastened to the cleat (22) on the rod (19), FIG. 13. At this stage, the sleeve is slid along the cover, FIG. 14, folding and compacting up to its retractable position on the stretch of rope (12) above the cover (1), in order to not hamper the others deployment maneuvers of the release cover (1). At this point the flaps of the cover (1) are brought outwards, FIG. 15, the rope (7), placed, also via eyelets (5), on the lower perimeter of the lower part (3) of the cover (1), is pulled from the stern of the boat, in order to make the cover adhere to the boat as much as possible and then the rope is fastened, FIG. 16. If necessary, the rope (17) is adjusted to ensure the tension of the cover (1), also to prevent water stagnation. To store the cover (1) it will be simply necessary to retrace in reverse the stages listed above.

The invention claimed is:

1. A universal and rapid covering system for boats and suitable for any other vehicle and object, comprising of a cover (1), a coupling means (10), a support structure (39), a system for lifting (38), a sleeve (15), and an anchoring means (37); said coupling means (10) is placed on the cover (1), said support structure (39) is positioned externally to the cover (1) and is capable of ensuring a height greater than the object to be covered, said system for lifting (38) is anchored to the support structure (39), said anchoring means (37) is placed on the sleeve (15) and allows connection between the sleeve (15) and the coupling means (10) of the cover (1), and between the sleeve (15) and the system for lifting (38), the sleeve is collected and held on the anchoring means in a collapsed position to allow the use of the cover (1) wherein said sleeve (15) is not rigid and is able to encase and uncover the entire cover (1) extending and compacting the total length of the sleeve (15), by easily and quickly sliding on the cover (1).

2. The universal and rapid covering system according to claim 1, wherein said cover (1) comprises a reinforcing fabric (6) along one or more ridge lines that can terminate on both ends with a hook (9).

3. The universal and rapid covering system according to claim 2, wherein said coupling means (10) of the cover comprises a hook applied on the reinforcing fabric (6), which is positioned depending on the size and the shape of the cover (1) to ensure the tension of the entire cover (1) and to make the managing of the cover (1) functional.

4. The universal and rapid covering system according to claim 1, wherein said cover (1) comprises a water-repellent upper part (2) and a windproof, breathable and elastic lower part (3), having a rope (7) and eyelets (5) or a hinge.

5. The universal and rapid covering system according to claim 4, wherein the upper part (2) and the lower part (3) of said cover (1) are joined together and are interspersed with slots (40) that allow both the access to a part of the object covered from the outside, and the access to the outside from the object covered.

6. The universal and rapid covering system according to claim 1, wherein said cover (1) is provided with a back opening (36) as to allow access to the object covered any time and without any difficulties.

7. The universal and rapid covering system according to claim 1, wherein the cover (1) is fastened to the object to be covered by means of spring clamps.

8. The universal and rapid covering system according to claim 1, wherein said coupling means (10) of the cover is positioned depending on the size and the shape of the cover (1) to ensure the tension of the entire cover (1) and to make the managing of the cover (1) functional, and comprises two joints in the shape of discs (25, 26) with eyebolts (21).

9. The universal and rapid covering system according to claim 1, wherein said sleeve (15) is constituted of material made of fabric or of a series of rings (30) connected to each other and spaced with ropes (31, 32).

10. The universal and rapid covering system according to claim 1, wherein said anchoring means (37) of the sleeve comprises a disc (33) with a double eye (34, 35) eyebolt (14), with a lower eye (34) and an upper eye (35).

11. The universal and rapid covering system according to claim 10, wherein said anchoring means (37) of the sleeve comprises a stretch of a rope (12) of at least equal length to the sleeve (15) in its retracted position, at the ends of which are positioned hooks (11, 13) to allow the connection on the one side to the coupling means (10) of the cover and on the other side to the lower eye (34) of the double eye (34, 35) eyebolt (14) of the anchoring means (37) of the sleeve.

12. The universal and rapid covering system according to claim 1, wherein said system for lifting (38) comprises a hook (16), a rope (17), a pulley (18) and a device suitable for anchoring, and pulling said rope (17) that is activated manually (22) or by mechanical (23) or electrical (24) means.

13. The universal and rapid covering system according to claim 1, wherein said support structure (39) comprises a rod (19) properly sized depending on the object to be covered and, therefore, depending on the cover (1) in order to obtain a height greater than the object to be covered, and the rod (19) can consist of a single element or of a various elements, and the rod (19) is fixed to the ground or to any other suitable structure (20) to support the rod (19).

* * * * *